United States Patent [19]

Glenn et al.

[11] 4,232,627

[45] Nov. 11, 1980

[54] BRACKET FOR ELEVATING AND LOWERING AN OUTBOARD MOTOR

[75] Inventors: Ronnie D. Glenn; Claude V. Myers, both of Eldorado, Ark.

[73] Assignee: G & M Enterprises, Inc., El Dorado, Ark.

[21] Appl. No.: 17,058

[22] Filed: Mar. 2, 1979

[51] Int. Cl.[3] ..... B63H 5/12

[52] U.S. Cl. ..... 440/61; 248/641

[58] Field of Search ..... 115/17, 41 R, 41 HT, 115/18; 248/640, 641, 642, 643; 254/88, 89 R, 89 H, 93 R

[56] References Cited

U.S. PATENT DOCUMENTS

| | | | |
|---|---|---|---|
| 2,638,863 | 5/1953 | Kiebler et al. | 248/643 X |
| 3,035,812 | 5/1962 | Wineteer | 254/89 R X |
| 3,085,785 | 4/1963 | Peterson | 254/93 R X |
| 3,242,899 | 3/1966 | Hanson | 248/642 X |
| 3,421,723 | 1/1969 | Holt | 248/642 |
| 3,809,343 | 5/1974 | Adams et al. | 248/642 |
| 4,089,290 | 5/1978 | Miles, Sr. et al. | 115/41 R |

*Primary Examiner*—Trygve M. Blix
*Assistant Examiner*—Winston H. Douglas
*Attorney, Agent, or Firm*—Diller, Ramik & Wight

[57] ABSTRACT

This disclosure relates to a bracket for elevating and lowering an outboard motor relative to the transom of an associated boat including two pair of relatively telescopic tubular elements each connected to a pair of mounting members adapted to be secured to a boat transom and an outboard motor, respectively, an outermost one of the pair of the tubular elements having an elongated slot in each and a guiding element disposed in each slot and connected between an associated one of the innermost elements and one of the outboard motor mounting members for guiding the relative telescopic motion between the two pair of elements.

10 Claims, 5 Drawing Figures

BRACKET FOR ELEVATING AND LOWERING AN OUTBOARD MOTOR

The invention is directed to a bracket for elevating and lowering an outboard motor relative to a transom of an associated boat to afford the latter proper "trim" under all speeds and/or loads and is particularly characterized in being constructed from a relatively few number of parts which thereby afford efficiency in operation and ease of mounting and demounting relative to a boat transom and/or outboard motor.

In keeping with the foregoing a primary object of this invention is to provide a novel outboard motor bracket which includes two pair of relatively telescopic elements each secured to a pair of mounting members adapted for attachment to an outboard motor and a boat transom, respectively, each of the outermost tubular elements having elongated slots, and guide means disposed in each of the slots and secured between each of the innermost elements and one member of the pair of mounting members for guiding the relative telescopic motion of the elements during elevating and/or lowering of the outboard motor relative to the boat transom.

A further object of this invention is to provide a novel bracket of the type aforesaid including power means between the first and second pair of telescopic elements for imparting relative telescopic motion therebetween, the power means including at least one fluid motor defined by a piston rod and cylinder, first pivot means pivotally connecting the cylinder to one of the first and second pair of mounting members, second pivot means for pivotally connecting the piston rod to the other of the first and second pair of mounting members, and the first and second pivot means having axes disposed generally normal to each other.

Still another object of this invention is to provide a novel bracket of the type herein described wherein one of the pair of mounting members are angle iron members each having first and second flanges, each first flange having a pair of recesses, and the slotted tubular elements being seated in the recesses.

With the above and other objects in view that will hereinafter appear, the nature of the invention will be more clearly understood by reference to the following detailed description, the appended claims and the several views illustrated in the accompanying drawings.

Figure 1:
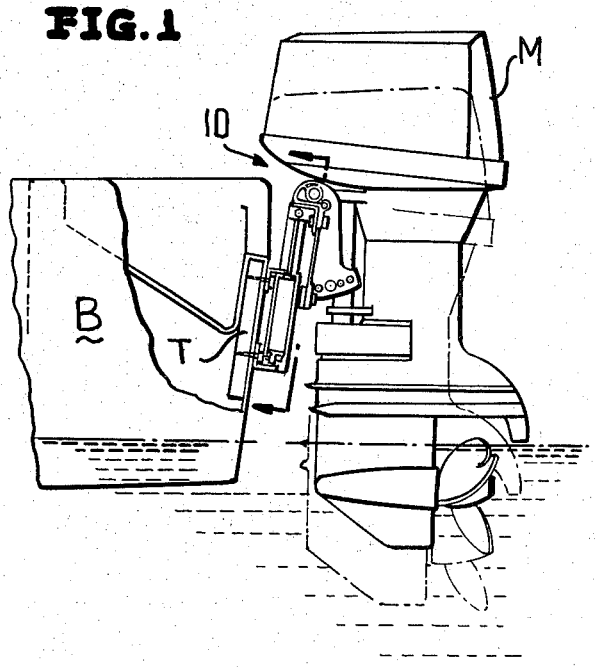
FIG. 1 is a fragmentary side elevational view, and illustrates a bracket of this invention connected to a boat transom and carrying an outboard motor.
Figure 3:
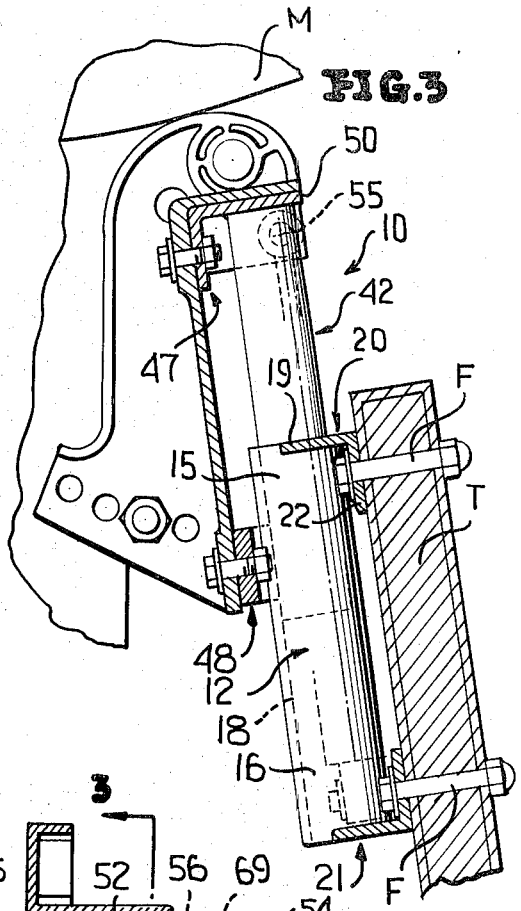
FIG. 3 is a fragmentary sectional view taken generally along line 3—3 of FIG. 2 and illustrates details of the manner in which the bracket is secured to the boat transom and an outboard motor.

A novel bracket constructed in accordance with this invention for elevating and lowering an outboard motor M is generally designated by the reference numeral 10, and, as is best illustrated in FIGS. 1 and 3, is secured both to the outboard motor M and a transom T of a boat.

The bracket 10 includes a first pair of generally elongated tubular elements 11, 12 (FIG. 5) each having axially opposite end portions 13, 14 and 15, 16, respectively, and respective slots 17, 18. The tubular elements 11, 12 are carried by a first pair of spaced generally parallel transom mounting members 20, 21 in the form of angle irons each having first and second flanges 19,22 and 23, 24, respectively. The flanges 19 have generally circular recesses or openings, 25, 26 receiving the upper end portions 13, 15, respectively, of the respective tubular elements 11,12. The flange 23 likewise includes generally circular recesses or apertures 27, 28 for receiving the lower end portions 14, 16, respectively, of the respective tubular elements 11, 12. The elements 11, 12 and the mounting members 20, 21 are formed of metal and are united together by welding (not shown) in the area of the recesses or openings 25 through 28. The latter forms a relatively rigid structure and retains the axes of the tubular elements 11, 12 in generally parallel relationship to each other as are the slots 17, 18, respectively, thereof.

The members 20, 21 include a plurality of openings 30, 31 formed in the flanges 22, 24, respectively, through which pass associated bolts or like fasteners F (FIG. 3) for securing the transom mounting members 20, 21 to the transom T (FIG. 3).

A generally rectangular plate 32 is welded to the flange 24 of the mounting member 21 and carries a plurality of apertures 33 for securing thereto a conventional D.C. reverse polarity electrically operated pump 34 (FIG. 2) operative for a purpose and in a manner to be described more fully hereinafter. The flange 24 of the mounting member 21 also includes a pair of pins 35, 36 having respective bores 37, 38 for receiving cotter pins, again in a manner and for a purpose to be described hereinafter.

Figure 5:
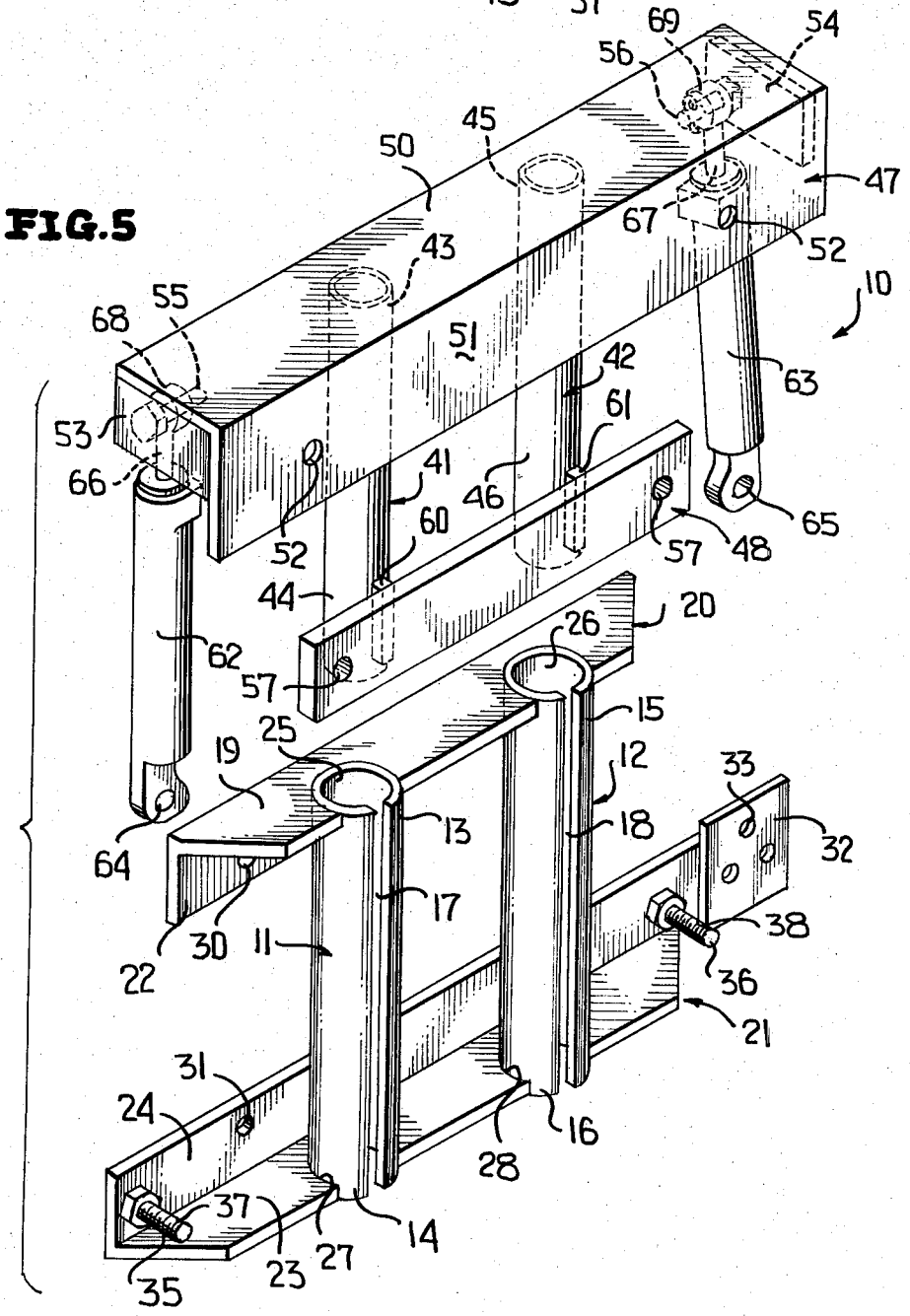
FIG. 5 is an exploded perspective view of the bracket of this invention, and illustrates various details thereof including a pair of fluid motors each including a cylinder and piston rod connected to mounting members of the bracket for imparting lifting and lowering motion thereto.

The bracket 10 further includes another pair of tubular elongated members or elements 41, 42 having respective axially opposite end portions 43, 44 and 45, 46 FIG. 5). A pair of spaced generally parallel motor mounting members 47, 48 are welded or otherwise secured to the tubular elements 41, 42. The motor mounting member 47 is an angle iron having a pair of flanges 50, 51, the latter of which includes means 52 in the form of apertures for receiving bolts or like fasteners F (FIG. 3) for securing the motor M thereto through its mounting bracket (unnumbered). The mounting member 47 also includes a pair of side flanges 53, 54 carrying respective pins 55, 56 in axially opposed relationship to each other.

The mounting member 48 also includes a plurality of means in the form of apertures or openings 57 for likewise receiving the fasteners F to secure the motor M to the mounting member 48.

Figure 4:
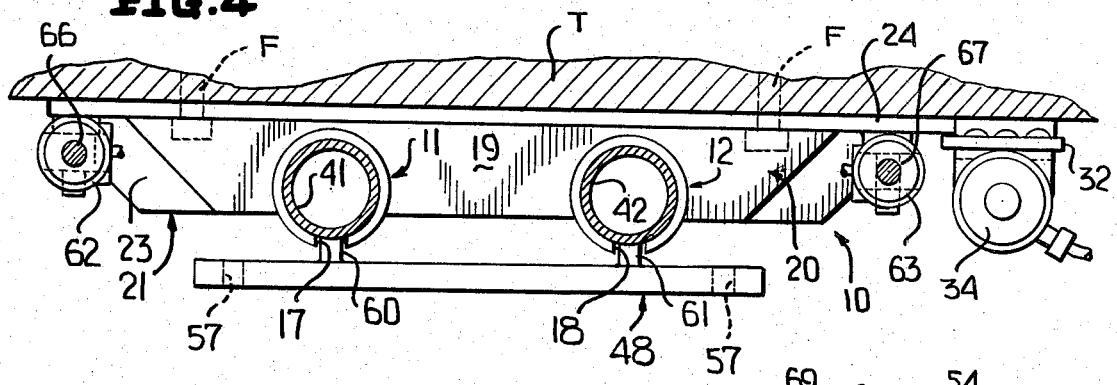
FIG. 4 is a fragmentary sectional view taken generally along line 4—4 of FIG. 2, and more clearly illustrates the telescopic relationship of the two pair of tubular elements, the slots in the outer tubular elements, and the manner in which one of the mounting members is secured to the inner tubular elements through the slots of the outer tubular elements.

Guiding and spacing means 60, 61 are welded or otherwise secured to the tubular elements 41, 42, respectively, and to the mounting member 48. The means 60, 61 are elongated pieces of metal whose longitudinal axes are in parallel relationship to each other and the function to both space the mounting member 48 from the tubular elements 41, 42 and to guide the relative telescopic motion between the elongated elements 41, 42 and the elements 11, 12, respectively, as the guiding means 60, 61 move within the respective slots 17, 18, as is most evident from FIGS. 2, 4 and 5 of the drawings.

Figure 2:
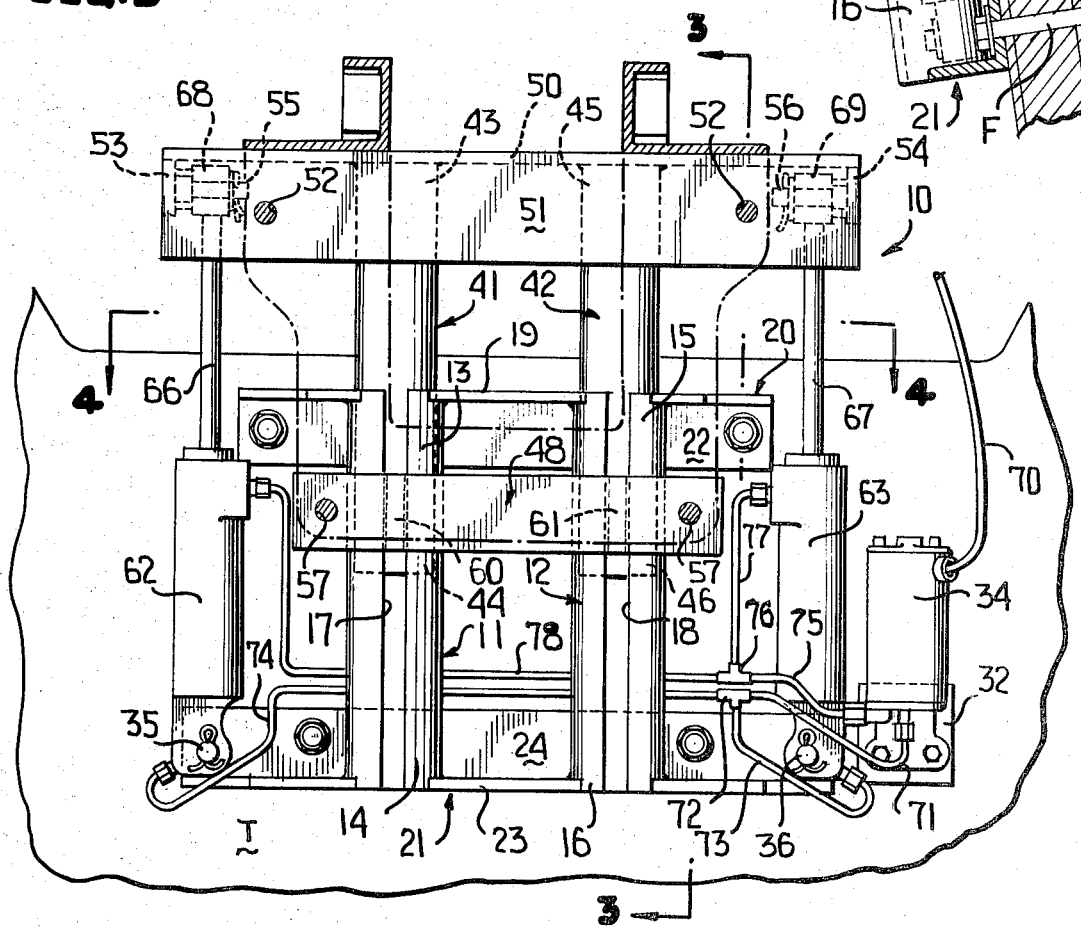
FIG. 2 is an enlarged fragmentary view taken generally along line 2—2 of FIG. 1, and illustrates a pair of elongated tubular elements in sliding telescopic relationship each of which carries a pair of mounting members, and a slot in an outermost of each of the tubular elements guidingly receiving a member secured to each internal tubular element and one of the pair of mounting members.

The lifting and lowering motion imparted to the motor M to the bracket 10 is achieved by a pair of power means in the form of hydraulic cylinders 62, 63 having respective bores 64, 65 which receive the respective pins 35, 36 and are locked into position by cotter pins (unnumbered) in a manner clearly illustrated in FIG. 2. Slidably received in each of these cylinders 62, 63 is a respective piston rod 66, 67 having respective apertured eyes 68, 69 which receive the pins 55, 56 and the associated cotter pins (unnumbered) associated therewith. As is most readily apparent from FIGS. 2, 3 and 5 of the drawings, upon the introduction of hydraulic fluid into the cylinders 62, 63 the piston rods 66, 67, respectively, are extended therefrom to lift or move the mounting members 47, 48 and the tubular elements 41 42 upwardly and thus similarly lift the motor M to the uppermost solid outline position shown in FIG. 1 while reverse motion lowers the motor M to its lowermost position shown in phantom outline in FIG. 1.

Reference is now made to FIG. 2 of the drawings which illustrates a hydraulic system for delivering hydraulic fluid to and removing hydraulic fluid from the cylinders 62, 63. The hydraulic system (unnumbered) includes the electrically operated pump 34 which is a D.C. polarity reversing pump of a conventional construction which includes a reservoir (not shown) for the hydraulic fluid. The pump 34 is connected by a conductor 70 to a reversing switch (not shown) on board the boat B which is in turn connected to a D.C. power source, such as a conventional marine battery. When the switch is in its "home" position the hydraulic system is "locked" and the piston rods 66, 67 are held immobilized in any position relative to the respective cylinders 62, 63.

In a second position of the switch hydraulic fluid is pumped from the mechanism of the pump 34 through a conduit 71, a T-connector 72 and conduits 73, 74 to the piston side of the rods 66, 67 to extend the same relative to the cylinders 62, 63 respectively.

In the remaining position of the switch the pump 34 reverses and hydraulic fluid is delivered by conduit 75, a T-connector 76, and conduit 77, 78 to the rod side of the cylinders 62, 63 to retract the piston rods 66, 67, respectively.

In the latter two positions of the electric switch the hydraulic system operates in the conventional manner such that as the piston side of the cylinders 60, 63 is pressurized through the conduits 73, 74 the rod side is vented through the conduits 77, 78 back to the reservoir of the pump 34 and vice versa.

Although only a preferred embodiment of the invention has been specifically illustrated and described herein, it is to be understood that minor variations may be made in the apparatus without departing from the spirit and scope of the invention, as defined in the appended claims.

We claim:

1. A bracket for elevating and lowering an outboard motor relative to the transom of an associated boat comprising a first pair of generally elongated tubular elements disposed with their axes in generally parallel relationship, an elongated slot in each of said tubular elements likewise disposed in generally parallel relationship, a first pair of spaced generally parallel transom mounting members secured at axially opposite end portions of said tubular elements, means for facilitating the securing of said mounting members to a boat transom, a second pair of elongated elements disposed with their axes in generally parallel relationship, said second pair of elongated elements being disposed in internal telescopic sliding relationship relative to said first pair of tubular elements, a second pair of spaced generally parallel motor mounting members secured at axially opposite end portions of said second pair of elements, means for facilitating the securing of said second pair of mounting members to an outboard motor, power means between said first and second pair of mounting members for imparting relative telescopic motion between said first and second pair of elements, and means between at least one of said second pair of elements and the slot associated therewith for guiding the relative sliding movement of said first and second pair of elements.

2. The bracket as defined in claim 1 including means between the other of said second pair of elements and the slot associated therewith for guiding the relative sliding movement of said first and second pair of elements.

3. The bracket as defined in claim 2 wherein said guiding means cooperatively spaces said one and other of said second pair of elements from one of said second pair of mounting members.

4. The bracket as defined in claim 3 wherein said guiding means is an elongated member exteriorly of said one and other of said second pair of elements and having longitudinal axes disposed in generally parallel relationship to each other and to said axes of said second pair of elements.

5. The bracket as defined in claim 4 wherein said power means include at least one fluid motor defined by a piston rod and cylinder, first pivot means pivotally connecting said cylinder to one of said first pair of mounting members, second pivot means for pivotally connecting said piston rod to one of said second pair of mounting members, and said first and second pivot means having axes disposed generally normal to each other.

6. The bracket as defined in claim 4 wherein said first pair of mounting members are angle iron members each having first and second flanges, each first flange having a pair of recesses, and said first pair of tubular elements being seated in said recesses.

7. The bracket as defined in claim 1 wherein said guiding means spaces said one of said second pair of elements from one of said second pair of mounting members.

8. The bracket as defined in claim 1 wherein said guiding means is an elongated member exteriorly of said one of said second pair of elements and having a longitudinal axis disposed in generally parallel relationship to said axes of said second pair of elements.

9. The bracket as defined in claim 1 wherein said power means include at least one fluid motor defined by a piston rod and cylinder, first pivot means pivotally connecting said cylinder to one of said first of mounting members, second pivot means for pivotally connecting said piston rod to one of said second pair of mounting members, and said first and second pivot means having axes disposed generally normal to each other.

10. The bracket as defined in claim 1 wherein said first pair of mounting members are angle iron members each having first and second flanges, each first flange having a pair of recesses, and said first pair of tubular elements being seated in said recesses.

* * * * *